US009265094B2

(12) United States Patent
Fukuda et al.

(10) Patent No.: US 9,265,094 B2
(45) Date of Patent: Feb. 16, 2016

(54) INDUCTION COOKING DEVICE

(75) Inventors: Hiroshi Fukuda, Hyogo (JP); Takashi Takehira, Hyogo (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 557 days.

(21) Appl. No.: 13/700,676

(22) PCT Filed: Jun. 24, 2011

(86) PCT No.: PCT/JP2011/003620
§ 371 (c)(1),
(2), (4) Date: Nov. 28, 2012

(87) PCT Pub. No.: WO2011/161974
PCT Pub. Date: Dec. 29, 2011

(65) Prior Publication Data

US 2013/0068757 A1 Mar. 21, 2013

(30) Foreign Application Priority Data

Jun. 25, 2010 (JP) ..... 2010-144635

(51) Int. Cl.
*H05B 6/12* (2006.01)
*H05B 6/06* (2006.01)

(52) U.S. Cl.
CPC ..... *H05B 6/062* (2013.01)

(58) Field of Classification Search
CPC ..... H05B 6/062; H05B 6/12
USPC ..... 219/209, 220, 494, 497, 621, 622, 625, 219/626, 627
See application file for complete search history.

(56) References Cited

U.S. PATENT DOCUMENTS 6,118,105 A * 9/2000 Berkcan et al. ..... 219/497
6,894,255 B2 * 5/2005 Fujii et al. ..... 219/621
2006/0081607 A1 * 4/2006 Niiyama et al. ..... 219/497
(Continued)

FOREIGN PATENT DOCUMENTS

CN 101116375 1/2008
JP 2005-158651 A 6/2005
(Continued)

OTHER PUBLICATIONS

International Search Report for International Application No. PCT/JP2011/003620, dated Aug. 2, 2011, 1 page.
(Continued)

*Primary Examiner* — Thien S Tran
(74) *Attorney, Agent, or Firm* — Brinks Gilson & Lione

(57) ABSTRACT

In an induction cooking device according to the present invention, a boiling-over detection portion is adapted to perform a heating-output suppression operation, on detecting boiling over, when the capacitances of electrodes have been changed by an amount equal to or more than a predetermined value. Further, the boiling-over detection portion is prevented from performing the heating-output suppression operation, if the boiling-over detection portion detects that the capacitances of the electrodes have been changed by an amount equal to or more than the predetermined value, due to the fact that the heating output of another heating coil in a heating area which is not subjected to boiling-over detection has been changed by an amount equal to or more than a predetermined change width.

19 Claims, 3 Drawing Sheets

(56) References Cited

U.S. PATENT DOCUMENTS

| | | | | |
|---|---|---|---|---|
| 2009/0020516 | A1* | 1/2009 | Niiyama et al. | 219/209 |
| 2009/0173731 | A1* | 7/2009 | Nagamitsu et al. | 219/622 |
| 2013/0068757 | A1* | 3/2013 | Fukuda et al. | 219/620 |

FOREIGN PATENT DOCUMENTS

| | | | |
|---|---|---|---|
| JP | 2008-159494 | A | 7/2008 |
| JP | 2009-289562 | A | 12/2009 |
| JP | 2010-97960 | A | 4/2010 |

OTHER PUBLICATIONS

International Preliminary Report on Patentability for International Application No. PCT/JP2011/003620, dated Jan. 15, 2013, 5 pages.
Office Action issued in Chinese application 201180024983.7, dated May 8, 2014, and English translation of Search Report.
Office Action and Search Report, and partial translation thereof, in corresponding Chinese Application No. 201180024983.7, dated May 8, 2014, 7 pages.
Extended European Search Report in European Application No. 11797862.7, dated Oct. 6, 2015, 5 pages.

* cited by examiner

INDUCTION COOKING DEVICE

This application is a 371 application of PCT/JP2011/003620 having an international filing date of Jun. 24, 2011, which claims priority to JP2010-144635 filed Jun. 25, 2010, the entire contents of which are incorporated herein by reference.

TECHNICAL FIELD

The present invention relates to induction cooking devices and, more particularly, relates to induction cooking devices capable of detecting boiling over in which liquid is spilling from containers being heated, such as pans, during heating cooking.

BACKGROUND ART

Conventionally, induction cooking devices of this type have been adapted to determine the capacitances of electrodes placed on the lower surface of a top plate and determine the occurrence of boiling over on detecting increases of these capacitances and then stop heating operations or decrease the high-frequency electric current flowing through a heating coil (refer to Unexamined Japanese Patent Publication No. 2008-159494 (Patent Literature 1), for example). In this structure, the phenomenon that, if liquid is boiled over to spread on the top plate upper surface around the electrodes, the capacitances of the electrodes increase to be larger than those of when no boiling over has occurred is used.

FIG. 3 is a view illustrating the structure for detecting boiling over, in the conventional induction cooking device described in Patent Literature 1.

As illustrated in FIG. 3, the conventional induction cooking device includes a driving circuit 102 to supply high-frequency electric power to a heating coil 104 when low-frequency electric power is inputted thereto from an AC power supply 101, in order to inductively heat a container to be heated (not illustrated). Further, a plurality of circular electrodes 103 are dispersively placed near the outer periphery of the heating coil 104. The respective circular electrodes 103 placed dispersively are connected to a capacitance determination circuit 106. The capacitance determination circuit 106 detects the capacitance between each circular electrode 103 and the capacitance determination circuit 106. A control circuit 105 is adapted such that signals from the capacitance determination circuit 106 are inputted thereto and is adapted to determine the temperature of the container being heated control heating operations of the driving circuit 102 based on boiling-over detection operations and the results of the detection. The capacitance determination circuit 106 detects boiling over on detecting abrupt increases in the capacitances of the circular electrodes 103 and stops detecting boiling over until the container being heated reaches a predetermined temperature which induces boiling over.

PLT 1: Unexamined Japanese Patent Publication No. 2008-159494

SUMMARY OF THE INVENTION

Technical Problem

With the structure of the conventional induction cooking device, the capacitance determination circuit 106 has been adapted to apply high-frequency signals to the circular electrodes 103 and to detect the changes in the capacitances of the circular electrodes 103, in order to detect the presence or absence of boiling over. Therefore, high-frequency noises generated from other heating coils and from pans and the like as containers to be heated may have been superimposed on the signals inputted to the capacitance determination circuit 106, which may have apparently changed the capacitances determined by the capacitance determination circuit 106. For example, even when no boiling over has occurred in the heating area to be subjected to boiling-over detection, if the setting of the heating output for an adjacent heating area is changed, high-frequency noises propagate to the container being heated in the heating area to be subjected to boiling-over detection, from the container being heated in the adjacent heating area, which may apparently change the capacitances determined by the capacitance determination circuit 106. The occurrence of such situations has induced the problem that the control circuit 105 falsely determines that boiling over has occurred and unnecessarily stops the heating operation of the driving circuit 102.

The present invention was made in order to overcome the aforementioned problem in the conventional induction cooking devices and aims at providing an induction cooking device capable of avoiding false detection of occurrences of boiling over for preventing unnecessary interruption of cooking for preventing unnecessary reduction of the heating output, in the case of operating a heating coil in a heating area to be subjected to boiling-over detection and another heating coil in a heating area which is not subjected to boiling-over detection, at the same time.

Solution to Problem

In order to overcome the aforementioned problem in conventional induction cooking devices, a boiling-over detection portion, in an induction cooking device according to the present invention, is adapted to detect boiling over when the capacitances of electrodes (boiling-over detection electrodes) provided near a heating coil provided in a heating area to be subjected to boiling-over detection have changed by an amount equal to or more than a predetermined value. Further, the boiling-over detection portion is adapted to perform no boiling-over detection operation, even when the capacitances of the electrodes (the boiling-over detection electrodes) have been changed by an amount equal to or more than the predetermined value, based on heating information about another heating coil in a heating area which is not subjected to the boiling-over detection. The induction cooking device thus structured according to the present invention is capable of accurately detecting the occurrence of boiling over in the induction cooking device including the plurality of heating coils and is capable of preventing false determinations of occurrences of boiling over in the state where no boiling over has occurred.

An induction cooking device of a first aspect according to the present invention includes:

a top plate;

a first heating coil and a second heating coil being provided under the top plate and being capable of heating a container to be heated, the container being placed on the top plate;

a first inverter control portion adapted to supply a high-frequency electric current to the first heating coil and to control a heating output;

a second inverter control portion adapted to supply a high-frequency electric current to the second heating coil and to control a heating output of the second heating coil such that the heating output reaches a set value;

a heating-information detection portion adapted to detect heating information about the second heating coil;

one or more electrodes provided on a lower surface of the top plate and placed near an outer peripheral portion of the first heating coil;

a high-frequency signal generating portion adapted to supply a high-frequency signal to each of the electrodes; and a boiling-over detection portion adapted to determine a capacitance in each of the electrodes, to detect an occurrence of boiling over from the container being heated by the first heating coil when the capacitance in one of the electrodes has been changed by an amount equal to or more than a predetermined value and to perform a heating-output suppression operation for reducing the heating output of the first heating coil or stopping a heating operation through the first inverter control portion, on detecting the occurrence of boiling over;

wherein the boiling-over detection portion is adapted to be prohibited from performing the heating-output suppression operation for the first heating coil, when the boiling-over detection portion has detected that the capacitance in the one electrode has been changed by an amount equal to or more than the predetermined value, and when the boiling-over detection portion determines that the occurrence of boiling over has been detected due to the fact that the heating output of the second heating coil has been changed, based on the heating information about the second heating coil from the heating-information detection portion.

With the induction cooking device having the structure in the first aspect, the boiling-over detection portion can be prevented from falsely detecting that the capacitances of the electrodes provided around the first heating coil have been changed, due to changes of high-frequency magnetic fields generated from the second heating coil and from the container being heated, along with the change of the heating output of the second heating coil. Accordingly, the induction cooking device in the first aspect is capable of preventing the boiling-over detection portion from unnecessarily performing the heating-output suppression operation for the first heating coil, on falsely detecting the occurrence of boiling over from the container being heated by the first heating coil, when the heating output of the second heating coil has been changed.

In an induction cooking device of a second aspect according to the present invention, the boiling-over detection portion in the induction cooking device of said first aspect is adapted to be prohibited from performing the heating-output suppression operation, when the detection portion detects that the setting of the heating output of the second heating coil has been changed by a change width equal to or more than a predetermined value based on the heating information about the second heating coil from the heating-information detection portion and also, the change of the setting was achieved until the elapse of a first predetermined time period since the change of the setting was made. The induction cooking device having the structure in the second aspect is capable of preventing the boiling-over detection portion from unnecessarily performing the heating-output suppression operation for the first heating coil, when the heating output of the second heating coil has been changed.

In an induction cooking device of a third aspect according to the present invention, the boiling-over detection portion in the induction cooking device of said first aspect is adapted to be prohibited from performing the heating-output suppression operation, when the boiling-over detection portion detects that the setting of the heating output of the second heating coil has been changed by a change width equal to or more than the predetermined value based on the heating information about the second heating coil from the heating-information detection portion and also, the change of the setting was achieved until the elapse of a first predetermined time period since when the occurrence of boiling over was detected. The induction cooking device thus structured in the third aspect is capable of preventing the boiling-over detection portion from unnecessarily performing the heating-output suppression operation for the first heating coil, when the heating output of the second heating coil has been changed.

In an induction cooking device of a fourth aspect according to the present invention, the second heating coil in the induction cooking device in any of the first to third aspects is adapted to heat an aluminum container to be heated. With the induction cooking device having the structure in the fourth aspect, it is possible to exert the effects of the inventions in the first to third aspects more prominently, since the second heating coil is enabled to heat an aluminum container to be heated. In the case where aluminum is heated, a significantly-larger high-frequency magnetic field is generated, in comparison with the case where iron or a stainless-steel is heated. This causes larger high-frequency noises to be superimposed on the boiling-over detection portion. Accordingly, when the heating output of the second heating coil has been changed in a state where an aluminum pan is being heated by the second heating coil, a larger voltage change is induced in the boiling-over detection portion, which may cause the boiling-over detection portion to determine that the capacitances of the electrodes have been largely changed. Therefore, the boiling-over detection portion according to the present invention is capable of exerting, more prominently, the effect of preventing unnecessary execution of the heating-output suppression operation when no boiling over has occurred, according to the inventions in the first to third aspects. This also enables simplification of a noise-reduction structure in the boiling-over detection portion.

In an induction cooking device of a fifth aspect according to the present invention, the induction cooking device in any of the first to third aspects further includes a voltage conversion portion adapted to convert a high-frequency voltage inputted thereto from the electrodes into a DC voltage, wherein the boiling-over detection portion is adapted to determine a detected DC voltage outputted from the voltage conversion portion and to detect the occurrence of boiling over and perform the heating-output suppression operation when the detected DC voltage has been changed by an amount equal to or more than a predetermined value from a reference DC voltage corresponding to the detected DC voltage of when no boiling over has occurred. The induction cooking device thus structured in the fifth aspect is structured to detect the occurrence of boiling over, when the amount of change of the detected DC voltage from the reference DC voltage of when no boiling over has occurred is equal to or more than the predetermined value. Thus, the induction cooking device is structured to be capable of stably detecting the occurrence of boiling over, by detecting the amplitudes of the capacitances.

In an induction cooking device of a sixth aspect according to the present invention, the boiling-over detection portion in the induction cooking device of the third aspect is adapted to perform the heating-output suppression operation, when the boiling-over detection portion detects the occurrence of boiling over after the elapse of a second predetermined time period since when the boiling-over detection portion detected that the setting of the heating output of the second heating coil had been changed by a change width equal to or more than the predetermined value. The induction cooking device thus structured in the sixth aspect is structured to detect boiling over, after the heating output of the second heating coil has been changed and, then, reached the changed heating output value and stabilized, in order to prevent false detection of boiling over.

In an induction cooking device of a seventh aspect according to the present invention, the boiling-over detection portion in the induction cooking device in any of the first to third aspects is adapted to perform the heating-output suppression operation, when the boiling-over detection portion detects the occurrence of boiling over, after detecting that the second heating coil has reached the changed heating output. The induction cooking device thus structured in the seventh aspect is structured to perform no boiling-over detection at least until the heating output of the second heating coil reaches the changed heating output value, after detecting that the heating output of the second heating coil has been changed. Therefore, the induction cooking device is structured to detect boiling over, after the heating output of the second heating coil has been changed and reached the changed heating output value and stabilized, in order to prevent false detection of boiling over. This can prevent false detection of boiling over.

In an induction cooking device of an eighth aspect according to the present invention, the induction cooking device in any of the first to third aspects further includes an output adjustment key for setting the heating output of the second heating coil, wherein the boiling-over detection portion is adapted to be prohibited from performing the heating-output suppression operation, when the boiling-over detection portion has detected the occurrence of the boiling over, and when the heating-information detection portion detects that the setting of the heating output of the second heating coil has been changed by a change width equal to or more than the predetermined value, based on information from the output adjustment key. With the induction cooking device having the structure in the eighth aspect, the heating-information detection portion is capable of certainly detecting that the setting of the heating output has been changed with a simple structure, and the boiling-over detection portion can be prevented from unnecessarily performing the heating-output suppression operation, on falsely detecting the occurrence of boiling over.

In an induction cooking device of a ninth aspect according to the present invention, the induction cooking device in any of the first to third aspects further includes an input-current detection portion for detecting an input electric current from the second inverter control portion, wherein the boiling-over detection portion is adapted to be prohibited from performing the heating-output suppression operation, when the boiling-over detection portion has detected the occurrence of the boiling over, and when the heating-information detection portion detects that the input electric current from the second inverter control portion has been changed by a change width equal to or more than a predetermined value, based on information from the input-current detection portion. With the induction cooking device having the structure in the ninth aspect, the input-current detection portion is capable of certainly detecting that the setting of the heating output has been changed with a simple structure, and the boiling-over detection portion can be prevented from unnecessarily performing the heating-output suppression operation on falsely detecting the occurrence of boiling over.

Advantageous Effects of the Invention

With the present invention, it is possible to provide an induction cooking device capable of avoiding false detection of occurrences of boiling over for preventing unnecessary interruption of cooking for preventing unnecessary reduction of the heating output, in the case of operating a heating coil in a heating area to be subjected to boiling-over detection and another heating coil in a heating area which is not subjected to boiling-over detection, at the same time.

DETAILED DESCRIPTION OF THE PREFERRED EMBODIMENTS

Hereinafter, with reference to the accompanying drawings, there will be described a concrete embodiment of an induction cooking device according to the present invention. Further, the present invention is not limited to the concrete structure which will be described in the following embodiment and is intended to include structures based on technical concepts equivalent to the technical concepts which will be described in the following embodiment and based on technical common senses in the present technical field.

First Embodiment

Figure 1:
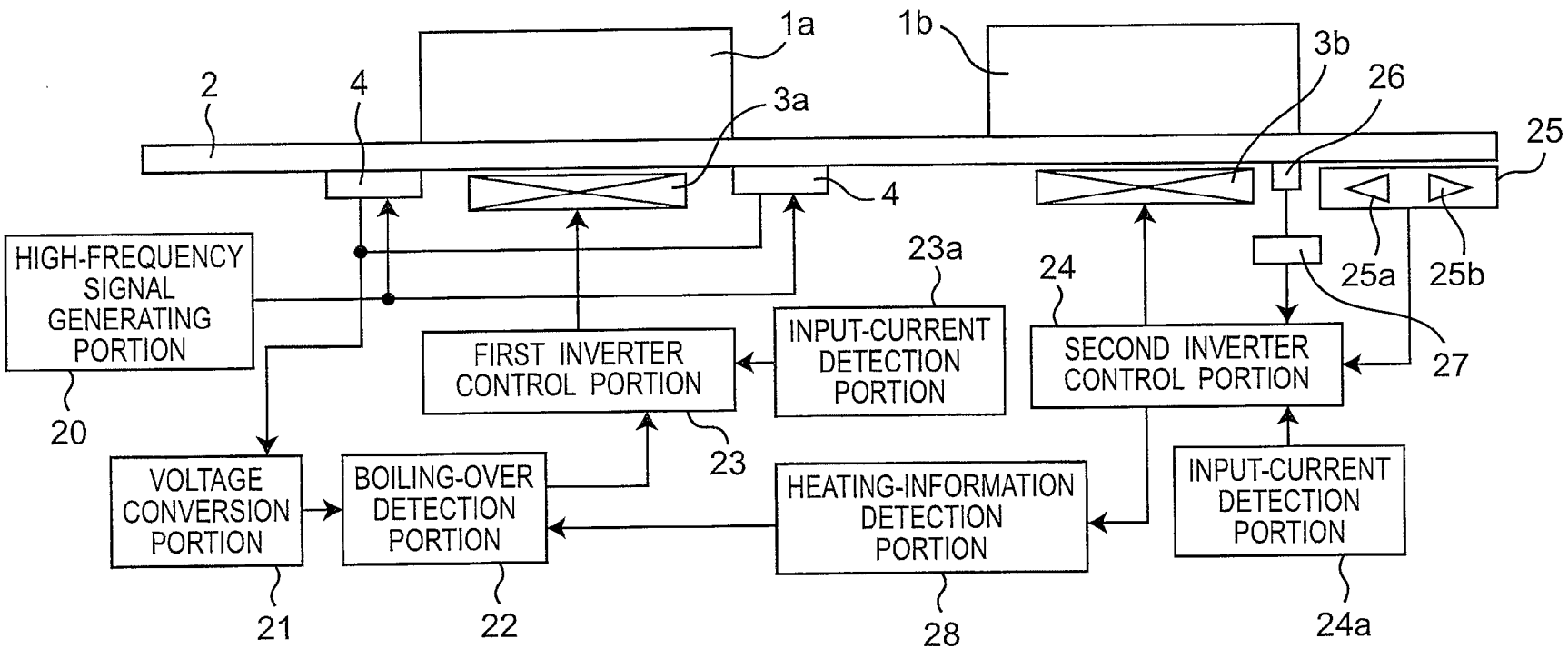
FIG. 1 is a block diagram illustrating the structure of an induction cooking device according to a first embodiment according to the present invention.
Figure 2:
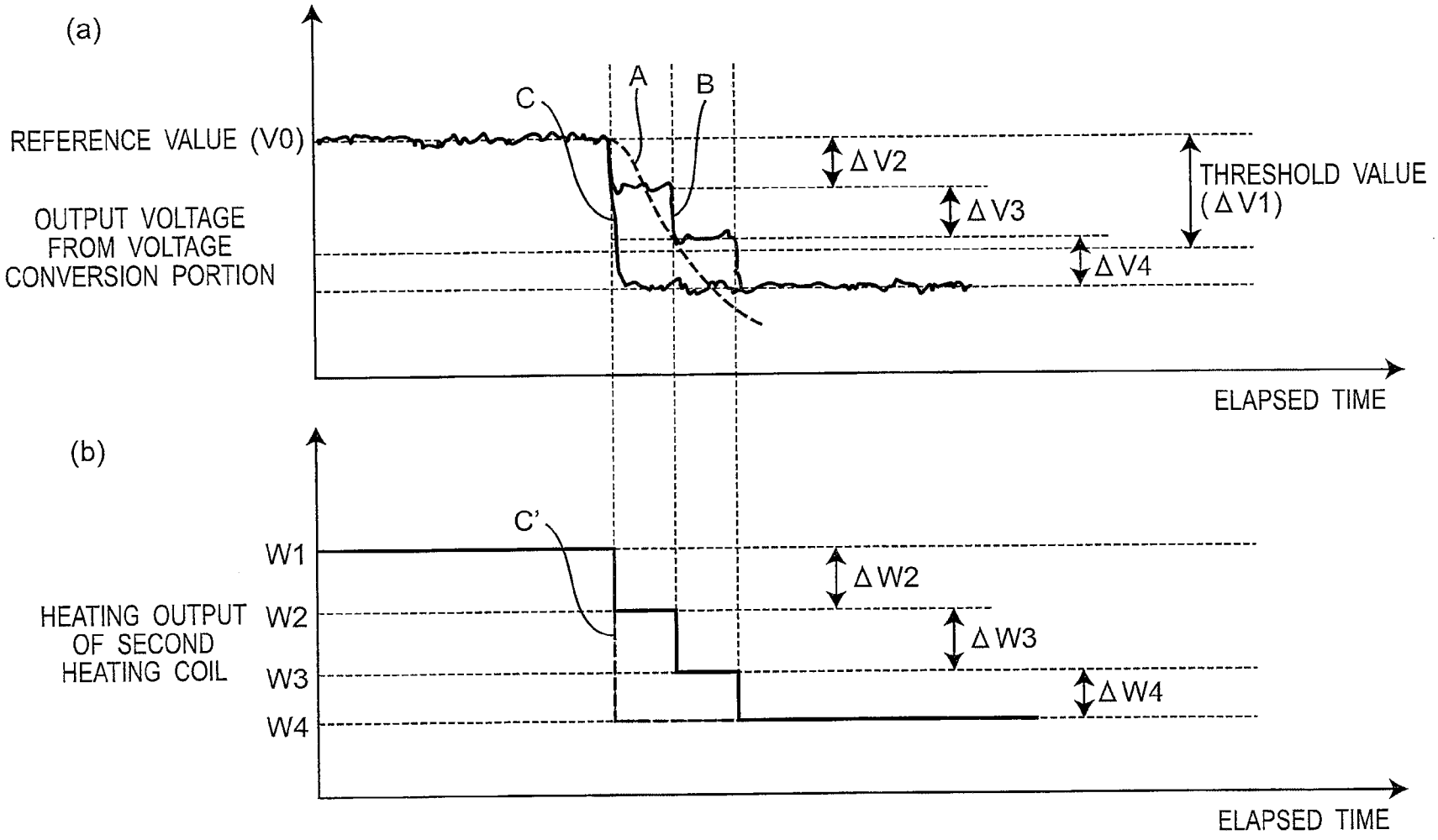
FIG. 2 is a waveform diagram (a) of an output voltage from a voltage conversion portion in the induction cooking device of the first embodiment according to the present invention, and a view (b) illustrating the change of a heating output of a second heating inverter with the elapse of time.
Figure 3:
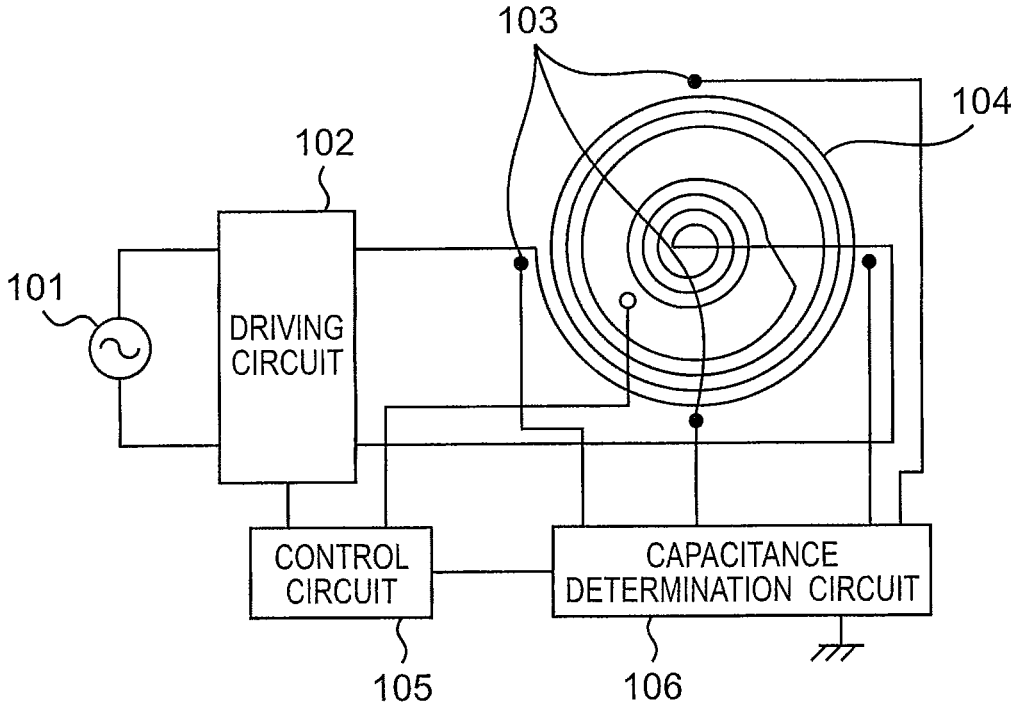
Fig.3 Prior Art
FIG. 3 is the view illustrating the structure for detecting boiling over in the conventional induction cooking device.

FIG. 1 is a block diagram illustrating the structure of an induction cooking device according to a first embodiment of the present invention. (a) of FIG. 2 is a waveform diagram illustrating an output voltage to a boiling-over detection portion from a voltage conversion portion, in the induction cooking device according to the first embodiment of the present invention. (b) of FIG. 2 is a waveform diagram illustrating a heating output from a second heating coil in the induction cooking device according to the first embodiment.

Referring to FIG. 1, under a top plate 2 which forms an upper portion of the outer contour of the induction cooking device according to the first embodiment, two heating coils, which are a first heating coil 3*a* and a second heating coil 3*b*, are provided. The induction cooking device according to the first embodiment will be described with an example where the top plate 2 is made of a crystallized glass, but it is not limited to a crystallized glass in the present invention. The first heating coil 3*a* is adapted to inductively heat a container to be heated, which is placed on the top plate 2, such as a first pan 1*a* made of iron. A first inverter control portion 23 includes an inverter (not illustrated), and a control circuit for driving and controlling the inverter. The first inverter control portion 23 is adapted to supply, to the first heating coil 3*a*, a high-frequency electric current with a predetermined frequency, such as a frequency of about 20 kHz, when a detection signal is inputted from an input current detection portion 23*a* for detecting the input current from the first inverter control portion 23.

The second heating coil 3*b* is capable of heating a second pan 1*b* made of a metal, including a pan made of iron or aluminum, as a container to be heated which is placed on the top plate 2, with a heating output of 2 kW, for example. A second inverter control portion 24 includes an inverter (not illustrated), and a control circuit for driving and controlling the inverter. The second inverter control portion 24 supplies, to the second heating coil 3*b*, a high-frequency electric current with a predetermined frequency, such as about 20 kHz in the case of heating an iron pan, and about 60 kHz in the case of heating an aluminum pan, when a detection signal is inputted from an input current detection portion 24*a* for detecting the input current of the second inverter control portion 24.

The induction cooking device according to the first embodiment is provided with a heating-information detection portion 28, and a manipulation portion 25 which enables a user to make settings of heating conditions and the like in the induction cooking device. The manipulation portion 25 is provided with an output decrease key 25*a* for decreasing the heating output, as an output adjustment key, and is provided with an output increase key 25*b* for increasing the heating output, as an output adjustment key (see FIG. 1). Further, heating information about the second heating coil 3*b* is inputted to the heating-information detection portion 28 from the input current detection portion 24*a* and the manipulation portion 25 through the second inverter heating portion 24, and the heating-information detection portion 28 outputs a signal corresponding to the heating information to a boiling-over detection portion 22.

The induction cooking device according to the first embodiment is provided, on the lower surface of the top plate 2, with a plurality of electrodes 4 (boiling-over detection electrodes) having an arc shape when viewed from the above, in such a way as to surround the outer peripheral portion of the first heating coil 3*a* provided just under the heating area to be subjected to boiling-over detection, near the outer peripheral portion. A high-frequency signal generating portion 20 supplies a high-frequency signal with a frequency of about 100 kHz, for example, to each of the electrodes 4. The electrodes 4 are provided on the lower surface of the top plate 2, through a forming method, such as printing (coating), adhesion or pressure welding of a conductive material such as carbon, and any of the forming methods can be employed therefor. In the case of forming them through pressure welding, a conductor sheet (such as a copper sheet) formed on a printed wiring board can be pressed against the lower surface of the top plate 2.

A voltage conversion portion 21 outputs a DC voltage corresponding to the capacitance between each electrode 4 and a predetermined electric potential (such as a metal cabinet which is grounded, for example). In the induction cooking device according to the first embodiment, a common electric potential (a grounded electric potential) in the voltage conversion portion 21 is defined as the predetermined electric potential. Hereinafter, for ease of description, "the capacitance between each electrode 4 and the predetermined electric potential" will be also simply referred to as "the capacitance of each electrode 4".

The boiling-over detection portion 22 detects boiling over of a liquid contained in the first pan 1*a*, by detecting the amount of change (ΔV) of the output voltage outputted from the voltage conversion portion 21 from a reference value (V0), which will be described later. On detecting boiling over, the boiling-over detection portion 22 performs a heating-output suppression operation for reducing the heating output of the first heating coil 3*a* or stopping the heating operation, through the first inverter control portion 23. In the following description, the term "performing a heating-output suppression operation" indicates performing an operation for reducing the heating output or stopping the heating operation, based on the detection of boiling over.

Next, operations of the induction cooking device having the aforementioned structure according to the first embodiment will be described.

The first inverter control portion 23 performs control for changing the high-frequency current supplied to the first heating coil 3*a*, in such a way as to attain the heating output having been set through the output adjustment keys, which are not illustrated, after the start of heating with the first heating coil 3*a* in the heating area to be subjected to boiling-over detection.

On the other hand, after the start of heating with the second heating coil 3*b* provided in the heating area which is not subjected to boiling-over detection, a desired heating output is set by manipulating the output decrease key 25*a* or the output increase key 25*b*, which is an output adjustment key provided in the manipulation portion 25 for the second heating coil 1*b*. The second inverter control portion 24 performs control for changing the high-frequency current supplied to the second heating coil 3*b*, in such a way as to attain the set heating output.

The boiling-over detection portion 22 for detecting boiling over from the first pan 1*a* to be heated by the first heating coil 3*a* is adapted to, on detecting the occurrence of boiling over, perform a heating-output suppression operation for reducing the heating output of the first heating coil 3*a* or stopping the heating operation, through the first inverter control portion 23.

The electrodes 4 (the boiling-over detection electrodes) are formed on the lower surface of the top plate 2, through printing (coating), adhesion, pressure welding, and the like, of a conductive material, which causes formation of capacitors between them and the conductor on the top plate 2, such as the first pan 1*a* or liquid, for example. Further, a capacitor is also formed between the first heating coil 3*a* and the conductor on the top plate 2.

In the waveform diagram illustrated in (a) of FIG. 2, a broken line A designates a curved line representing a change of the output voltage from the voltage conversion portion 21 with the elapse of time, in the event of the occurrence of boiling over. When no boiling over has occurred, the first pan 1*a* exists on the top plate 2, while conductors, such as the first heating coil 3*a* and the electrodes 4, exist under the top plate 2. As described above, the spatial positional relationship between these conductors determines the capacitances detected by the boiling-over detection portion 22.

(a) of FIG. 2 illustrates the reference value (V0: a reference DC voltage) which is the value of the output of the voltage conversion portion 21 in the case where no boiling over has occurred, which corresponds to the capacitance of each electrode 4 when no boiling over has occurred.

On the other hand, if boiling over occurs to cause the liquid in the first pan 1*a* to spread on the top plate 2 or to bring the liquid into contact with the first pan 1*a* or with a frame (not illustrated) provided at the peripheral edge portion of the top plate 2, this changes the electric-potential distribution in the conductor on the upper surface of the top plate 2, thereby changing the capacitances detected by the boiling-over detection portion 22. If the boiling-over detection portion 22 detects that the amount of change (ΔV) of the output voltage (the detected DC voltage) from the voltage conversion portion 21 from the reference value (V0) has come to be equal to or more than a voltage-value threshold value (ΔV1), the boiling-over detection portion 22 determines that boiling over has occurred and, thus, detects boiling over. Namely, the boiling-over detection portion 22 determines that boiling over has occurred and thus, detects boiling over, if the amount of change (ΔC) in the capacitance (C) of any of the electrodes 4 has come to be equal to or more than a capacitance threshold value (ΔC1), in comparison with cases where no boiling over has occurred.

On the other hand, when the second pan 1*b* is being heated by the second heating coil 3*b*, high-frequency radiative noises are generated from the second heating coil 3*b* and the second pan 1*b*. These noises increase with increasing heating output. Further, in the case where the second pan 1*b* is made of aluminum, significantly larger noises are generated therefrom, in comparison with the case where a pan made of iron is heated with the same heating output. The occurrence of such noises exerts influences on the voltage conversion portion 21 directly from the second heating coil 3*b*, indirectly through a pan and the like placed behind the first pan 1*a* or the second pan 1*b*, or indirectly through a pan and the like being placed between the first pan 1*a* and the second pan 1*b*, thereby changing the output voltage from the voltage conversion portion 21. Further, as a result, in proportion to the amplitude of the heating output of the second heating coil 3*b*, the output voltage from the voltage conversion portion 21 is changed.

For example, as illustrated in (b) of FIG. 2, when the second heating coil 3*b* is being currently stabilized at a heating-output set value W1, if the output decrease key 25*a* is manipulated a single time, the set value is decreased by a change width ΔW2, thereby decreasing the heating output of the second heating coil 3*b* to W2. Subsequently, the same manipulation is further performed twice, the heating output is further decreased by a change width ΔW3 and a change width ΔW4 as decrease widths, thereby decreasing the heating output to W3 and W4, in a stepwise manner. At this time, referring to (a) of FIG. 2, as indicated by a line B, the output voltage (the detected DC voltage) from the voltage conversion portion 21 is influenced by the change of the output voltage to the second heating coil 3*b* and thus, is decreased along therewith.

If the output decrease key 25*a* is successively manipulated, as described above, to cause the sum (ΔW2+ΔW3+ΔW4) of the decrease widths for the second heating coil 3*b* to reach a predetermined value, such as 700 W or more, for example, the decrease width (ΔV2+ΔV3+ΔV4) of the output voltage from the voltage conversion portion 21 may come to be equal to or more than the voltage-value threshold value (ΔV1), due to influences of the decrease width for the second heating coil 3*b*. In such cases, the boiling-over detection portion 22 may determine that the amounts of changes (ΔC) in the capacitances of the electrodes 4 have come to be equal to or more than the capacitance threshold value (ΔC1) and thus, may falsely determine that boiling over has occurred, even though no boiling over has occurred.

Therefore, in order to prevent false determinations of boiling over as described above, in the induction cooking device according to the first embodiment, the boiling-over detection portion 22 is structured such that heating information about the heating-output set value, which is the target of control by the second inverter control portion 24, is inputted thereto from the heating-information detection portion 28. The boiling-over detection portion 22 is structured as follows. That is, even when the boiling-over detection portion 22 has detected that the amount of change (ΔV) of the output voltage from the voltage conversion portion 21 from the reference value (V0) has come to be equal to or more than the voltage threshold value (ΔV) or even when other conditions defined for determination of boiling over have been satisfied, if the boiling-over detection portion 22 detects that the set value has been changed to a heating output value by a predetermined change width until the elapse of a first predetermined time period since it detected that the amount of change (ΔV) had come to be equal to or more than the voltage threshold value (ΔV1), based on the heating information from the heating-information detection portion 28, for example, if the boiling-over detection portion 22 detects that the set value has been changed to a heating output value by a change width equal to or more than 700 W within 2 seconds, the boiling-over detection portion 22 is prohibited from performing heating-output suppression operations, namely it is prevented from performing boiling-over detection operation, until the elapse of the first predetermined time period.

The boiling-over detection portion 22 can be structured as follows. That is, when the boiling-over detection portion 22 has detected that the amount of change in the capacitance of any of the electrodes 4 is equal to or more than a predetermined value, if, immediately after this detection, namely until the elapse of the first predetermined time period (for example, 2 seconds) since this detection, the boiling-over detection portion 22 detects that the heating output has been changed, the boiling-over detection portion 22 does not detect boiling over.

Note that the boiling-over detection portion 22 can be also structured as follows. That is, after the time point the first predetermined time period (for example, 2 seconds) has elapsed since the boiling-over detection portion 22 detected that the heating output of the second heating coil 3*b* had been changed, if the boiling-over detection portion 22 detects that the amount of change (ΔV) of the output voltage from the voltage conversion portion 21 from the reference value (V0: the reference DC voltage) has come to be equal to or more than the voltage threshold value (ΔV1), the boiling-over detection portion 22 can detect boiling over. In other words, if the boiling-over detection portion 22 detects that the amount of change in the capacitance of any of the electrodes 4 has come to be equal to or more than the predetermined value, in the case where, just before this detection, namely within the time interval from 2 seconds before this detection to the time point of this detection, the boiling-over detection portion 22 detected that the heating output of the second heating coil 3*b* had been changed, the boiling-over detection portion 22 does not detect boiling over.

As described above, during heating operations with both the first inverter control portion 23 and the second inverter control portion 24 at the same time, if the boiling-over detection portion 22 determines that the occurrence of boiling over has been detected since the heating-output set value has been changed based on the menu and the like having been preliminarily determined through the manipulation portion 25, even when other conditions for detecting boiling over have been satisfied, the boiling-over detection portion 22 performs no boiling-over detection operation.

Next, there will be described operations for preventing false determinations of boiling over by the boiling-over detection portion 22, when the heating output has been largely reduced, in the case where the heating output is changed during automatic cooking with the second heating coil 3*b*, for example.

The temperature of the second pan 1*b* being heated by the second heating coil 3*b* is detected by a temperature sensor 26, and signals resulted from the detection are inputted to the second inverter control portion 24 through a temperature adjustment portion 27.

During automatic cooking, based on the temperature detected by the temperature sensor 26, the temperature adjustment portion 27 exerts its temperature adjustment function for adjusting the temperature of the second pan 1*b*, and the second inverter control portion 24 controls the hating output of the second heating coil 3*b*. For example, if the temperature detected by the temperature sensor 26 reaches a predetermined temperature, the temperature adjustment portion 27 exerts its temperature adjustment function, which may largely change the heating output from W1 to W4 (the change width: ΔW2+ΔW3+ΔW4, for example, 700 W), as represented by a broken line C' in (b) of FIG. 2, When the heating output has been largely changed, as described above, as represented by a line C in (a) of FIG. 2, the output voltage (the detected DC voltage) to the boiling-over detection portion 22 from the voltage conversion portion 21 is also largely changed from the reference value (V0) (the change width: ΔV2+ΔV3+ΔV4). Accordingly, when the temperature adjustment portion 27 has exerted its temperature adjustment function, as described above, the output voltage from the voltage conversion portion 21 is caused to have a waveform similar to that of when boiling over has occurred, similarly to when the heating output has been forcibly reduced through the manipulation portion 25 as described above.

When the second inverter control portion 24 has largely changed the heating output during automatic cooking, as described above, the heating-information detection portion 28 transmits heating information about the second heating coil 3*b* to the boiling-over detection portion 22 and therefore, the boiling-over detection portion 22 can detect the change of the heating output of the second heating coil 3*b*, based on the heating information. The boiling-over detection portion 22 can be structured as follows, in order to offer the same effects. That is, if the boiling-over detection portion 22 detects that the heating output of the second heating coil 3*b* has been changed to be decreased by an amount equal to or more than a predetermined change width, similarly to when the heating output of the second heating coil 3*b* has been reduced through the output decrease key 25*a*, even when the capacitances of the electrodes 4 have been changed by an amount equal to or more than a predetermined change width, the boiling-over detection portion 22 is prohibited from performing heating-output suppression operations, namely it is prevented from performing boiling-over detection operation, if it detects that the heating output of the second heating coil 3*b* has been changed by a change width equal to or more than a predetermined value and also this change was achieved until the elapse of the first predetermined time period since this change was made.

Further, the boiling-over detection portion 22 can be adapted to be prohibited from performing heating-output suppression operations, if it detects that the heating output of the second heating coil 3*b* has been changed by a change width equal to or more than a predetermined value and also, this change was achieved until the elapse of the first predetermined time period since this change was made. Further, the boiling-over detection portion 22 is enabled to perform, again, boiling-over detection operations having been prohibited, after the time point a second predetermined time period (2 seconds, for example) has elapsed since it detected that the heating output of the second heating coil 3*b* had been changed by a change width equal to or more than the predetermined value. Thus, the boiling-over detection portion 22 is prevented from falsely determining that boiling over has occurred, by being influenced by the heating output of the second heating coil 3*b*. Further, the boiling-over detection portion 22 is enabled to automatically restore its function of detecting boiling over, after the elapse of the second predetermined time period.

With the structure described above, the induction cooking device according to the first embodiment is prevented from falsely determining the occurrence of boiling over and is enabled to automatically restore its function of detecting boiling over, after the elapse of the second predetermined time period since the detection of the heating output with the second heating coil 3*b*.

Further, the boiling-over detection portion 22 can be prevented from falsely detecting boiling over from the container being heated by the first heating coil 3*a*, since it can detect, from the heating information from the heating-information detection portion 28, that the heating output of the second heating coil 3*b* has been changed by a change width equal to or more than the predetermined value through the output decrease key 25*a* and the output increase key 25*b* in the manipulation portion 25. This enables provision of an induction cooking device with a simple structure and excellent reliability.

In the induction cooking device according to the first embodiment, the input current from the second inverter control portion 24 which has been detected by the input-current detection portion 24*a* is inputted to the heating-information detection portion 28, through the second inverter control portion 24. Accordingly, the boiling-over detection portion 22 is capable of detecting that the input current from the second inverter control portion 24 has been changed by a change width equal to or more than a predetermined value. As described above, in the induction cooking device according to the first embodiment, the boiling-over detection portion 22 detects the change of the heating output of the second heating coil 3*b* and therefore, the boiling-over detection portion 22 enables provision of an induction cooking device capable of boiling-over detection with a simple structure and with excellent reliability.

Further, if boiling over has occurred, and the boiled-over liquid comes into contact with the first pan 1*a*, this may increase the output voltage from the voltage conversion portion 21. Namely, in the event of the occurrence of boiling over, the capacitances of the electrodes 4 may exhibit a behavior (a phenomenon) as if they have been decreased. In cases where the boiling-over detection portion 22 detects the presence or absence of boiling over utilizing this phenomenon, the structure according to the invention of the present application can be also applied to the case where the heating output of the second heating coil 3*b* has been increased, similarly to cases where the output voltage from the voltage conversion portion 21 has been reduced due to the occurrence of boiling over, as described above. For example, when the heating output of the second heating coil 3*b* has been increased, the boiling-over detection portion 22 can be prevented from detecting boiling over, only within the first predetermined time period before and after the time point of the increase of the heating output. More specifically, the boiling-over detection portion 22 can be structured as follows. That is, when the set value of the heating output of the second heating coil 3*b* has been increased by a change width equal to or more than a predetermined value, such as by 700 W or more, for example, through the output increase key 25*b* in the manipulation portion 25, even if the capacitances of the electrodes 4 are changed by an amount equal to or more than the capacitance threshold value (ΔC1), within the first predetermined time period before and after detecting the change of the setting through the heating-information detection portion 28, the boiling-over detection portion 22 determines that the occurrence of boiling over has been detected due to the change of the heating output of the second heating coil 3*b*, and the boiling-over detection portion 22 is prevented from detecting boiling over.

In the induction cooking device according to the first embodiment, the second inverter control portion 24 can have the function of detecting the material of the second pan 1*b* and can be adapted to output the result of the determination of the material to the boiling-over detection portion 22 through the heating-state detection portion 28. The boiling-over detection portion 22 is enabled to perform boiling-over detection, prohibited from performing boiling-over detection or enabled to change conditions for prohibiting boiling-over detection, according to the material of the second pan 1*b* being heated by the second heating coil 1*b*. For example, in the case where the second heating coil 3*b* is capable of heating a pan made of aluminum, as the second pan 1*b* to be heated, when the boiling-over detection portion 22 has acquired information about the fact that the second pan 1*b* made of iron is being heated by the second heating coil 3*b*, even if it detects that the heating output of the second heating coil 3*b* has been changed by an amount equal to or more than a predetermined change width, the boiling-over detection portion 22 is not prohibited from performing boiling-over detection and is enabled to immediately perform boiling-over detection.

On the other hand, when the boiling-over detection portion 22 has acquired information about the fact that the second pan 1*b* made of aluminum is being heated by the second heating coil 3*b*, if it detects that the amount of change in the capacitance of any of the electrodes 4 is equal to or more than a predetermined value and also, shortly therebefore, the heating output of the second heating coil 3*b* was changed by a change width equal to or more than a predetermined change (700 W or more, for example), the boiling-over detection portion 22 can be prohibited from performing boiling-over detection. Namely, the boiling-over detection portion 22 can be structured as follows. That is, after the time point the first predetermined time period (2 seconds, for example) has elapsed since the boiling-over detection portion 22 detected that the heating output of the second heating coil 2*b* had been changed by a change width equal to or more than the predetermined value, if the boiling-over detection portion 22 detects that the amount of change ($\Delta V$) of the output voltage from the voltage conversion portion 21 from the reference value ($V\mathbf{0}$) has come to be equal to or more than the voltage threshold value ($\Delta V\mathbf{1}$), the boiling-over detection portion 22 can detect boiling over.

Alternatively, when the boiling-over detection portion 22 has acquired heating information about the fact that the second pan 1*b* made of aluminum is being heated by the second heating coil 3*b*, if it detects that the heating output of the second heating coil 3*b* has been changed by a change width equal to or more than the predetermined change (700 W or more, for example), the boiling-over detection portion 22 can be prohibited from performing boiling-over detection, immediately after the detection (until the elapse of the first predetermined time period (2 seconds, for example) since this detection).

Further, in the case of heating the second pan 1*b* made of iron, the boiling-over detection portion 22 can set the heating-output change width defined as the threshold value for prohibiting boiling-over detection to be a larger value (1.2 kW or more, for example) than that (700 W or more, for example) in the case of heating the second pan 1*b* made of aluminum. By setting the heating-output change width as described above, it is possible to prevent unnecessary false detection of boiling over.

Further, the induction cooking device according to the first embodiment has been described as being structured to provide the boiling-over detection portion 22 for the first heating coil 3*a*, but the present invention is not limited to this structure, and the boiling-over detection portion can be provided for the second heating coil 3*b* for inductively heating a pan made of iron or aluminum.

Further, the induction cooking device according to the first embodiment has been described as being structured to inductively heat a pan made of iron with the first heating coil 3*a*, but the present invention is not limited to this structure, and the first heating coil 3*b* can be also adapted to heat a pan made of aluminum.

Further, the induction cooking device according to the first embodiment has been described as being structured to include the first heating coil 3*a* and the second heating coil 3*b*, but the present invention is not limited to this structure, and the present invention can be also applied to a plurality of heating coils in either structures including two or more heating coils or structures including heaters formed from other heat-generating members in addition to a plurality of heating coils.

The induction cooking device according to the present invention is capable of detecting a container being heated in a state where boiling over has occurred, during heating, without being influenced by ambient conditions during cooking and therefore, is enabled to prevent malfunctions in boiling-over detection. Further, the induction cooking device according to the present invention is prevented from inducing malfunctions in boiling-over detection, which enables the user to continuously perform cooking without causing unnecessary interruptions. Thus, the induction cooking device according to the present invention forms a cooking apparatus with improved usability.

INDUSTRIAL APPLICABILITY

It is possible to provide, in the market, an induction cooking device with excellent reliability which is capable of largely reducing false detections of boiling over from a heating container, which may be induced during induction heating operations.

The invention claimed is:

1. An induction cooking device comprising:

atop plate;

a first heating coil in a first heating area subjected to boiling-over detection on the top plate and a container placed on first heating area of the top plate;

a second heating coil in a second heating area not subjected to boiling-over detection on the top plate and configured to heat a container placed on the second heating area of the top plate;

a first inverter control portion adapted to supply a high-frequency electric current to the first heating coil and to control a heating output;

a second inverter control portion adapted to supply a high-frequency electric current to the second heating coil and to control a heating output of the second heating coil such that the heating output reaches a set value;

a heating-information detection portion adapted to detect heating information about the second heating coil;

one or more electrodes on a lower surface of the top plate and near an outer peripheral portion of the first heating coil;

a high-frequency signal generating portion adapted to supply a high-frequency signal to each of the one or more electrodes; and a boiling-over detection adapted to determine a capacitance in each of the one or more electrodes, to detect an occurrence of boiling over from the container being heated by the first heating coil when the capacitance in one of the electrodes changes by an amount equal to or more than a predetermined value, and to perform a heating-output suppression operation for reducing the heating output of the first heating coil or stopping a heating operation through the first inverter control portion, on detecting the occurrence of boiling over;

wherein the boiling-over detection portion is adapted to be prohibited from performing the heating-output suppression operation for a first predetermined time period, when the boiling-over detection portion detects that a setting of the heating output of the second heating coil changes by a change width equal to or more than a predetermined value based on the heating information about the second heating coil from the heating-information detection portion; and the boiling-over detection portion is further adapted to be prohibited from performing the heating-output suppression operation, when the boiling-over detection portion detects boiling over, and when the heating-information detection portion detects that the input electric current from the second inverter control portion changes by a change width equal to or more than a predetermined value, based on information from the input-current detection portion.

2. The induction cooking device according to claim 1, wherein the boiling-over detection portion is adapted to be prohibited from performing the heating-output suppression operation, when the boiling-over detection portion detects that the setting of the heating output of the second heating coil changes by a change width equal to or more than a predetermined value based on the heating information about the second heating coil from the heating-information detection portion and also, wherein the change of the setting is achieved until an elapse of a first predetermined time period since the change of the setting.

3. The induction cooking device according to claim 1, wherein the boiling-over detection portion is adapted to be prohibited from performing the heating-output suppression operation, when the boiling-over detection portion detects that the setting of the heating output of the second heating coil changes by a change width equal to or more than a predetermined value based on the heating information about the second heating coil from the heating-information detection portion and also, wherein the change of the setting is achieved until an elapse of a first predetermined time period since detection of boiling over.

4. The induction cooking device according to claim 1, wherein the second heating coil is configured to heat an aluminum container.

5. The induction cooking device according to claim 1, further comprising a voltage conversion portion adapted to convert a high-frequency voltage input thereto from the one or more electrodes into a DC voltage, wherein the boiling-over detection portion is adapted to determine a detected DC voltage output from the voltage conversion portion and to detect boiling over and to perform a heating-output suppression operation when the detected DC voltage changes by an amount equal to or more than a predetermined value from a reference DC voltage corresponding to the detected DC voltage in the absence of boiling over.

6. The induction cooking device according to claim 3, wherein the boiling-over detection portion is adapted to perform the heating-output suppression operation, when the boiling-over detection portion detects the occurrence of boiling over after an elapse of a second predetermined time period from when the boiling-over detection portion detected that the setting of the heating output of the second heating coil changed by a change width equal to or more than the predetermined value.

7. The induction cooking device according to claim 1, wherein the boiling-over detection portion is adapted to perform the heating-output suppression operation, when the boiling-over detection portion detects boiling over, after detecting that the second heating coil reached the changed heating output.

8. The induction cooking device according to claim 1, further comprising an output adjustment key for setting the heating output of the second heating coil, wherein the boiling-over detection portion is adapted to be prohibited from performing the heating-output suppression operation, when the boiling-over detection portion detects boiling over, and when the heating-information detection portion detects that the setting of the heating output of the second heating coil changes by a change width equal to or more than a predetermined value, based on information from the output adjustment key.

9. The induction cooking device according to claim 1, further comprising an input-current detection portion for detecting an input electric current from the second inverter control portion, wherein the boiling-over detection portion is adapted to be prohibited from performing the heating-output suppression operation, when the boiling-over detection portion detects boiling over, and when the heating-information detection portion detects that the input electric current from the second inverter control portion changes by a change width equal to or more than a predetermined value, based on information from the input-current detection portion.

10. The induction cooking device according to claim 2, wherein the second heating coil is configured to heat an aluminum container.

11. The induction cooking device according to claim 3, wherein the second heating coil is configured to heat an aluminum container.

12. The induction cooking device according to claim 2, further comprising a voltage conversion portion adapted to convert a high-frequency voltage input thereto from the electrodes into a DC voltage, wherein the boiling-over detection portion is adapted to determine a detected DC voltage output from the voltage conversion portion and to detect the occurrence of boiling over and to perform the heating-output suppression operation when the detected DC voltage changes by an amount equal to or more than a predetermined value from a reference DC voltage corresponding to the detected DC voltage of in the absence of boiling over.

13. The induction cooking device according to claim 3, further comprising a voltage conversion portion adapted to convert a high-frequency voltage input thereto from the one of more electrodes into a DC voltage, wherein the boiling-over detection portion is adapted to determine a detected DC voltage output from the voltage conversion portion and to detect the occurrence of boiling over and to perform the heating-output suppression operation when the detected DC voltage changes by an amount equal to or more than a predetermined value from a reference DC voltage corresponding to the detected DC voltage in the absence of boiling over.

14. The induction cooking device according to claim 2, wherein the boiling-over detection portion is adapted to perform the heating-output suppression operation, when the boiling-over detection portion detects boiling over, after detecting that the second heating coil has reached the changed heating output.

15. The induction cooking device according to claim 3, wherein the boiling-over detection portion is adapted to perform the heating-output suppression operation, when the boiling-over detection portion detects boiling over, after detecting that the second heating coil has reached the changed heating output.

16. The induction cooking device according to claim 2, further comprising an output adjustment key for setting the heating output of the second heating coil, wherein the boiling-over detection portion is adapted to be prohibited from performing the heating-output suppression operation, when the boiling-over detection portion has detected boiling over, and when the heating-information detection portion detects that the setting of the heating output of the second heating coil has changed by a change width equal to or more than a predetermined value, based on information from the output adjustment key.

17. The induction cooking device according to claim 3, further comprising an output adjustment key for setting the heating output of the second heating coil, wherein the boiling-over detection portion is adapted to be prohibited from performing the heating-output suppression operation, when the boiling-over detection portion has detected boiling over, and when the heating-information detection portion detects that the setting of the heating output of the second heating coil has changed by a change width equal to or more than a predetermined value, based on information from the output adjustment key.

18. The induction cooking device according to claim 2, further comprising an input-current detection portion for detecting an input electric current from the second inverter control portion, wherein the boiling-over detection portion is adapted to be prohibited from performing the heating-output suppression operation, when the boiling-over detection portion has detected boiling over, and when the heating-information detection portion detects that the input electric current from the second inverter control portion has changed by a change width equal to or more than a predetermined value, based on information from the input-current detection portion.

19. The induction cooking device according to claim 3, further comprising an input-current detection portion for detecting an input electric current from the second inverter control portion, wherein the boiling-over detection portion is adapted to be prohibited from performing the heating-output suppression operation, when the boiling-over detection portion has detected boiling over, and when the heating-information detection portion detects that the input electric current from the second inverter control portion has changed by a change width equal to or more than a predetermined value, based on information from the input-current detection portion.

* * * * *